US009364737B1

(12) United States Patent
McCurry

(10) Patent No.: US 9,364,737 B1
(45) Date of Patent: Jun. 14, 2016

(54) VISUAL SPORTS SCORE SEESAW DEVICE

(71) Applicant: William McCurry, Abbeville, SC (US)

(72) Inventor: William McCurry, Abbeville, SC (US)

( * ) Notice: Subject to any disclaimer, the term of this patent is extended or adjusted under 35 U.S.C. 154(b) by 48 days.

(21) Appl. No.: 14/580,310

(22) Filed: Dec. 23, 2014

(51) Int. Cl.
*A63B 71/06* (2006.01)
*G09F 23/14* (2006.01)

(52) U.S. Cl.
CPC ..... *A63B 71/06* (2013.01); *G09F 23/14* (2013.01)

(58) Field of Classification Search
None
See application file for complete search history.

(56) References Cited

U.S. PATENT DOCUMENTS

| | | | | |
|---|---|---|---|---|
| D229,076 | S | 11/1973 | Kurtenbach | |
| 3,868,671 | A | 2/1975 | Maguire | |
| D357,049 | S | 4/1995 | Crane | |
| 5,894,261 | A | 4/1999 | Green | |
| 6,816,130 | B1 | 11/2004 | Shishido | |
| 7,898,393 | B2 | 3/2011 | McMillan | |
| 2012/0120114 | A1 * | 5/2012 | You | G06F 3/017 345/676 |
| 2012/0256373 | A1 | 10/2012 | Tam | |

FOREIGN PATENT DOCUMENTS

| | | | |
|---|---|---|---|
| GB | 2465494 | A | 5/2010 |

* cited by examiner

*Primary Examiner* — Brian Zimmerman
*Assistant Examiner* — Kevin Lau
(74) *Attorney, Agent, or Firm* — Kyle A. Fletcher, Esq.

(57) ABSTRACT

The visual sports score seesaw device includes a miniature seesaw that includes a pair of rival teams and/or mascot-related indicia to be provided on distal ends of the seesaw. The base of the seesaw includes a first score and a second score to be entered in order to reflect the final score of an important rival game. Moreover, the rival team that won the important rival game is raised upwardly while the losing rival team is lowered. An embodiment may include a manual score adjustment knob for both the first score and the second score. Another embodiment may include an electronic display to be used and inputted for the first score and the second score.

20 Claims, 4 Drawing Sheets

VISUAL SPORTS SCORE SEESAW DEVICE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of sports-related memorabilia and collectibles, more specifically, a device that resembles a miniature seesaw that enables mascot related indicia and game scores to be displayed thereon.

SUMMARY OF THE INVENTION

An embodiment of the disclosure meets the needs presented above by generally comprising a miniature seesaw that includes a pair of rival teams and/or mascot-related indicia to be provided on distal ends of the seesaw. The base of the seesaw includes a first score and a second score to be entered in order to reflect the final score of an important rival game. Moreover, the rival team that won the important rival game is raised upwardly while the losing rival team is lowered. An embodiment may include a manual score adjustment knob for both the first score and the display to be used and inputted for the first score and the second score.

These together with additional objects, features and advantages of the visual sports score seesaw device will be readily apparent to those of ordinary skill in the art upon reading the following detailed description of presently preferred, but nonetheless illustrative, embodiments of the visual sports score seesaw device when taken in conjunction with the accompanying drawings.

In this respect, before explaining the current embodiments of the visual sports score seesaw device in detail, it is to be understood that the visual sports score seesaw device is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the visual sports score seesaw device.

It is therefore important that the claims be regarded as including such equivalent construction insofar as they do not depart from the spirit and scope of the visual sports score seesaw device. It is also to be understood that the phraseology and terminology employed herein are for purposes of description and should not be regarded as limiting.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DETAILED DESCRIPTION OF THE EMBODIMENT

Figure 1:
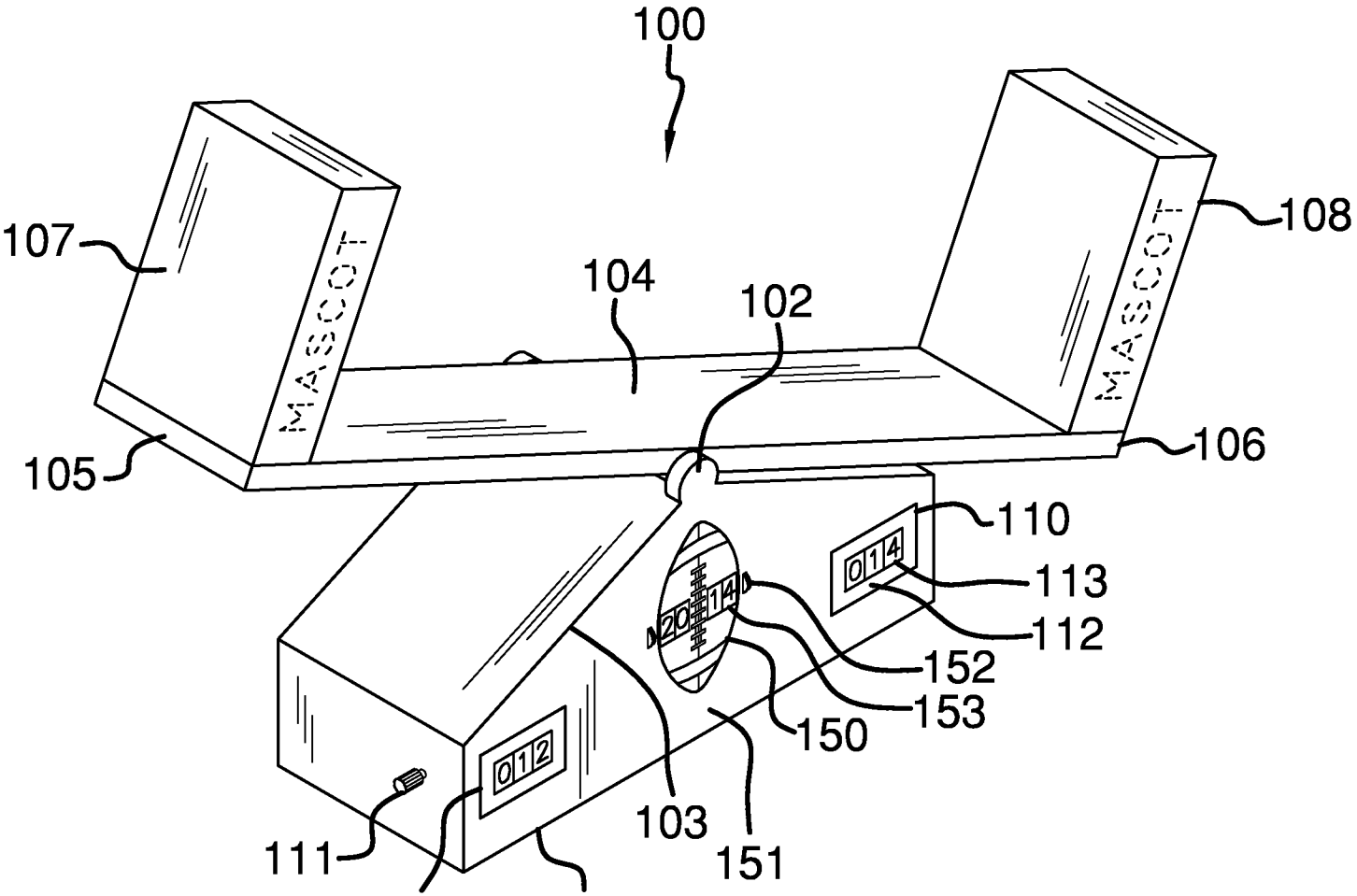
FIG. 1 is a perspective view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

As best illustrated in FIGS. 1 through 4, the visual sports score seesaw device 100 (hereinafter invention) generally comprises a base 101 that is configured to rest on a surface 200. The base 101 is of hollowed construction, and has an apex point 102 that is centrally located along a top edge 103.

A seesaw 104 is pivotably engaged with respect to the apex point 102 of the base 101. The seesaw 104 is able to rotate up and down about the apex point 102. Moreover, the seesaw 104 is further defined with a first distal end 105 and a second distal end 106. The first distal end 105 includes a first rival team member 107 seated thereon, whereas the second distal end 106 includes a second rival team member 108 seated thereon.

The base 101 includes a first scoring member 109 and a second scoring member 110. The first scoring member 109 is adjacent to the first distal end 105 of the seesaw 104. Moreover, the first scoring member 109 is used to correlate with the first rival team member 107. The second scoring member 110 is adjacent to the second distal end 106 of the seesaw 104. Moreover, the second scoring member 110 is used to correlate with the second rival team member 108.

Figure 2:
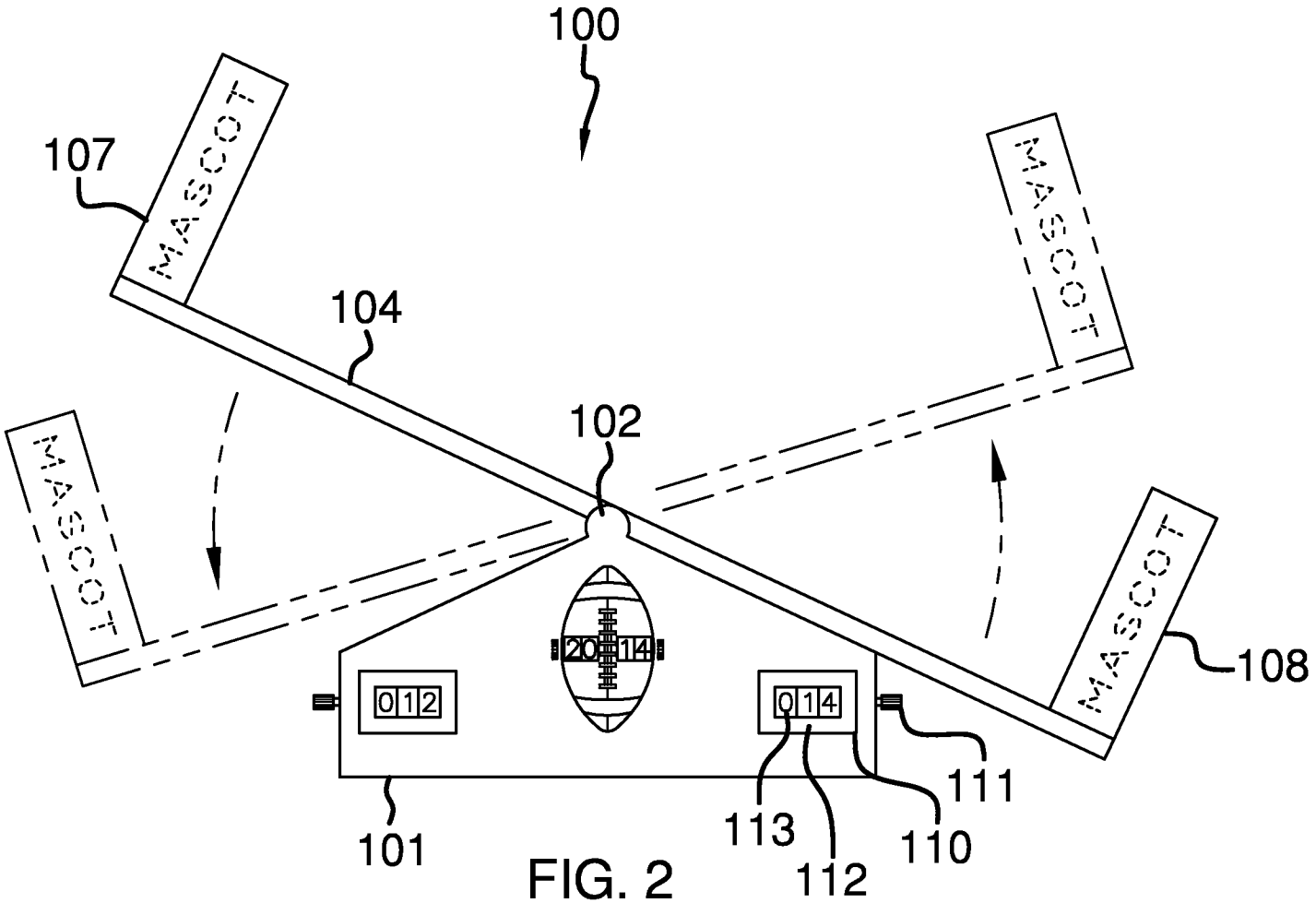
FIG. 2 is a front view of an embodiment of the disclosure.
Figure 3:
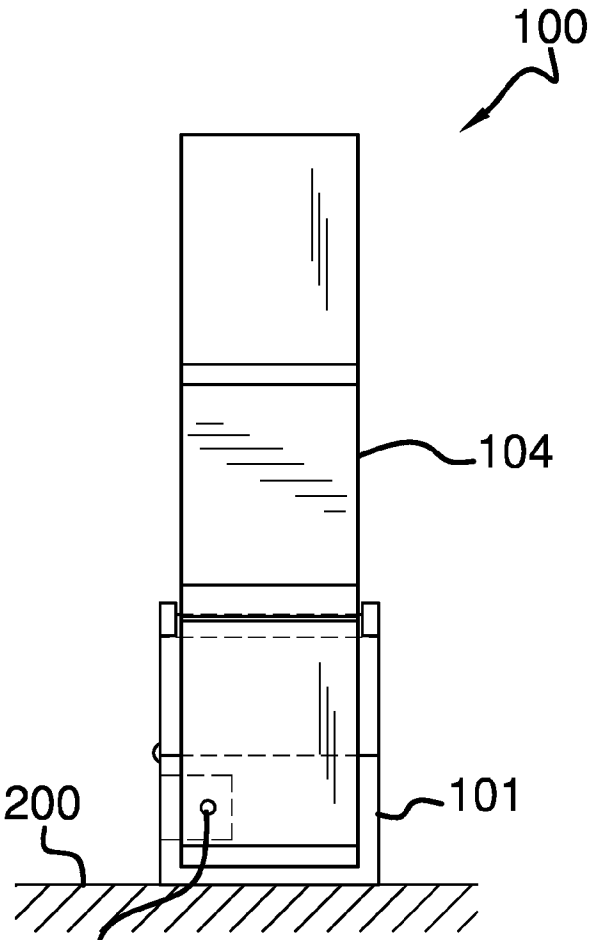
FIG. 3 is an end view of an embodiment of the disclosure.

Referring to FIGS. 1-3, the first scoring member 109 and the second scoring member 110 are counting devices that includes a score adjustment knob 111. The score adjustment knob 111 rotates a dial 112 to adjust numbers 113 provided thereon. The score adjustment knob 111 is used to adjust the numbers 113 in order to reflect a final score of an actual game that corresponds to the first rival team member 107 and the second rival team member 108. Moreover, the seesaw 104 is rotated to place the winning team up whereas the losing team is down.

Figure 4:
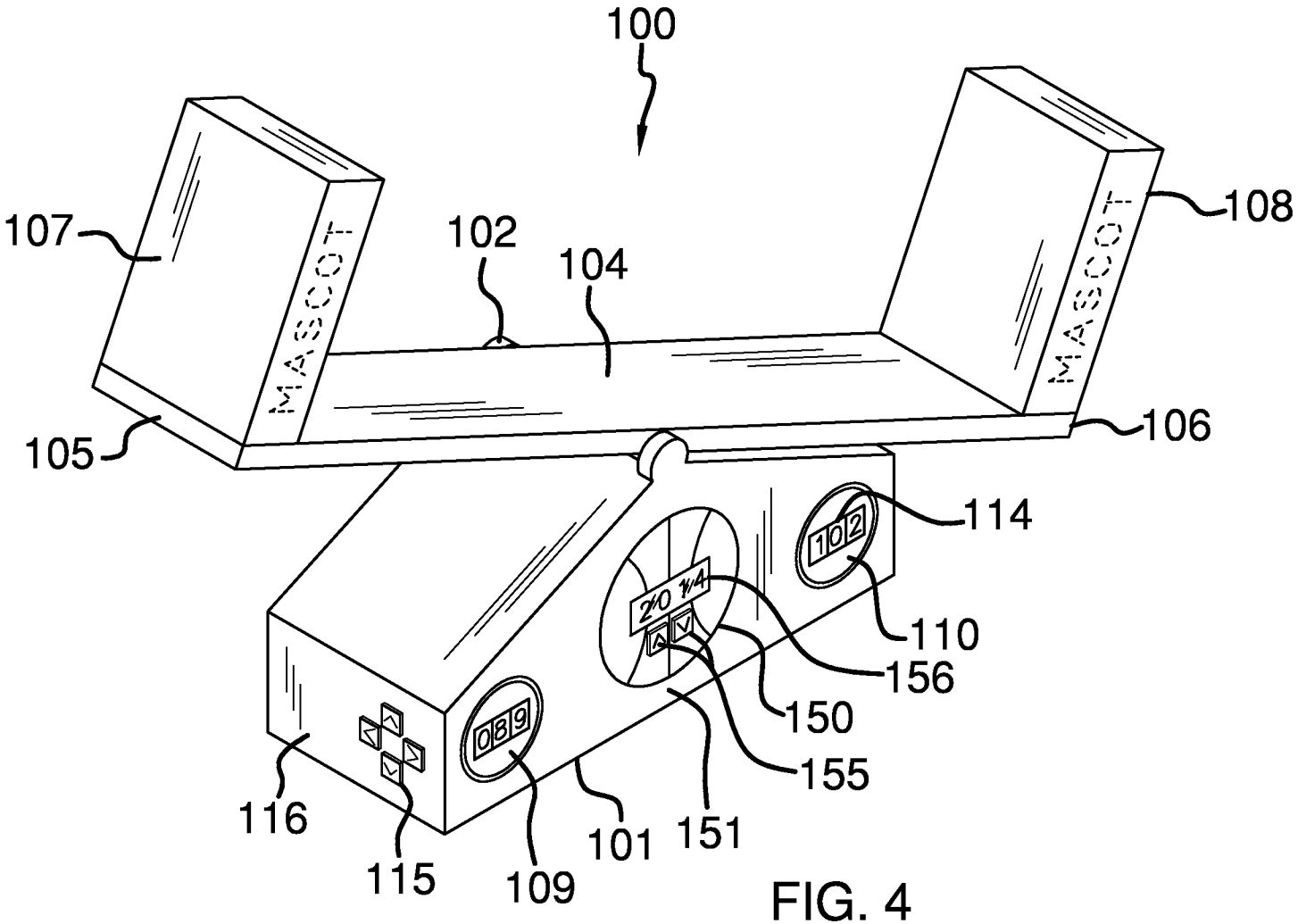
FIG. 4 is a perspective view of an alternative embodiment of the disclosure.

Referring to FIG. 4, the first scoring member 109 and the second scoring member 110 each include a digital display 114 that are each connected with a keyboard 115 located on a first base side surface 116 of the base 101. The keyboard 115 is used to adjust the output of the digital display 114 in order to represent a final score of an actual game that corresponds to the first rival team member 107 and the second rival team member 108.

A year display 150 is provided on a front surface 151 of the base 101. The year display 150 can be digital (see FIG. 4) or simply manually operated (see FIG. 1). The year display 150 includes a dial 152 that adjusts a year numbers 153 (see FIG. 1). In FIG. 4, the year display 150 includes buttons 155 that adjust a digital display 156 representing the year. The year display 150 is used to illustrate the year in which a game was played, whereby the final score is provided on the first scoring member 109 and the second scoring member 110.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A visual sports score seesaw device comprising:

a base with a seesaw rotatably engaged thereto;

wherein distal ends of the seesaw include either a first rival team member or a second rival team member;

wherein the base includes a first scoring member and a second scoring member;

wherein the first scoring member and the second scoring member are used to display an actual score of an actual game that corresponds with the first rival team member and the second rival team member;

wherein a winning team is rotated up on the seesaw whereas a losing team is rotated down on the seesaw.

2. The visual sports score seesaw device according to claim 1 wherein the base is configured to rest on a surface; wherein the base is of hollowed construction, and has an apex point that is centrally located along a top edge.

3. The visual sports score seesaw device according to claim 2 wherein the seesaw is pivotably engaged with respect to the apex point of the base; wherein the seesaw is able to rotate up and down about the apex point.

4. The visual sports score seesaw device according to claim 3 wherein the seesaw is further defined with a first distal end and a second distal end; wherein the first distal end includes the first rival team member seated thereon, whereas the second distal end includes the second rival team member seated thereon.

5. The visual sports score seesaw device according to claim 4 wherein the first scoring member is adjacent to the first distal end of the seesaw; wherein the first scoring member is used to correlate with the first rival team member; wherein the second scoring member is adjacent to the second distal end of the seesaw; wherein the second scoring member is used to correlate with the second rival team member.

6. The visual sports score seesaw device according to claim 5 wherein the first scoring member and the second scoring member each include a score adjustment knob; wherein the score adjustment knob rotates a dial to adjust numbers provided thereon.

7. The visual sports score seesaw device according to claim 5 wherein the first scoring member and the second scoring member each include a digital display that are each connected with a keyboard located on a first base side surface of the base.

8. The visual sports score seesaw device according to claim 7 wherein the keyboard is used to adjust the output of the digital display in order to represent the final score of the actual game that corresponds to the first rival team member and the second rival team member.

9. The visual sports score seesaw device according to claim 6 wherein a year display is provided on a front surface of the base; wherein the year display is able to display a year in which a game was played whereby the score is depicted on the first scoring member and the second scoring member.

10. The visual sports score seesaw device according to claim 9 wherein the year display includes a dial that adjusts a year numbers.

11. The visual sports score seesaw device according to claim 7 wherein a year display is provided on a front surface of the base; wherein the year display is able to display a year in which a game was played whereby the score is depicted on the first scoring member and the second scoring member.

12. The visual sports score seesaw device according to claim 11 wherein the year display includes buttons that adjust a digital display representing the year.

13. A visual sports score seesaw device comprising:

a base with a seesaw rotatably engaged thereto;

wherein distal ends of the seesaw include either a first rival team member or a second rival team member;

wherein the base includes a first scoring member and a second scoring member;

wherein the first scoring member and the second scoring member are used to display an actual score of an actual game that corresponds with the first rival team member and the second rival team member;

wherein a winning team is rotated up on the seesaw whereas a losing team is rotated down on the seesaw;

wherein a year display is provided on a front surface of the base; wherein the year display is able to display a year in which a game was played whereby the score is depicted on the first scoring member and the second scoring member;

wherein the base is configured to rest on a surface; wherein the base is of hollowed construction, and has an apex point that is centrally located along a top edge;

wherein the seesaw is pivotably engaged with respect to the apex point of the base; wherein the seesaw is able to rotate up and down about the apex point.

14. The visual sports score seesaw device according to claim 13 wherein the seesaw is further defined with a first distal end and a second distal end; wherein the first distal end includes the first rival team member seated thereon, whereas the second distal end includes the second rival team member seated thereon.

15. The visual sports score seesaw device according to claim 14 wherein the first scoring member is adjacent to the first distal end of the seesaw; wherein the first scoring member is used to correlate with the first rival team member; wherein the second scoring member is adjacent to the second distal end of the seesaw; wherein the second scoring member is used to correlate with the second rival team member.

16. The visual sports score seesaw device according to claim 15 wherein the first scoring member and the second scoring member each include a score adjustment knob; wherein the score adjustment knob rotates a dial to adjust numbers provided thereon.

17. The visual sports score seesaw device according to claim 15 wherein the first scoring member and the second scoring member each include a digital display that are each connected with a keyboard located on a first base side surface of the base.

18. The visual sports score seesaw device according to claim 17 wherein the keyboard is used to adjust the output of the digital display in order to represent the final score of the actual game that corresponds to the first rival team member and the second rival team member.

19. The visual sports score seesaw device according to claim 16 wherein the year display includes a dial that adjusts a year numbers.

20. The visual sports score seesaw device according to claim 18 wherein the year display includes buttons that adjust a digital display representing the year.

* * * * *